US007180457B2

(12) United States Patent
Trott et al.

(10) Patent No.: US 7,180,457 B2
(45) Date of Patent: Feb. 20, 2007

(54) WIDEBAND PHASED ARRAY RADIATOR

(75) Inventors: Keith D. Trott, Shrewsbury, MA (US); Joseph P. Biondi, Townsend, MA (US); Ronni J. Cavener, Andover, MA (US); Robert V. Cummings, Marlborough, MA (US); James M. McGuinnis, Salem, NH (US); Thomas V. Sikina, Acton, MA (US); Erdem A. Yurteri, Lawrence, MA (US); Fernando Beltran, Mashpee, MA (US)

(73) Assignee: Raytheon Company, Waltham, MA (US)

( * ) Notice: Subject to any disclaimer, the term of this patent is extended or adjusted under 35 U.S.C. 154(b) by 134 days.

(21) Appl. No.: 10/617,620

(22) Filed: Jul. 11, 2003

(65) Prior Publication Data

US 2005/0007286 A1 Jan. 13, 2005

(51) Int. Cl.
*H01Q 13/10* (2006.01)

(52) U.S. Cl. ..... 343/770; 343/771

(58) Field of Classification Search ..... 343/767, 343/770, 795, 797, 778, 786
See application file for complete search history.

(56) References Cited

U.S. PATENT DOCUMENTS

| | | | | |
|---|---|---|---|---|
| 3,836,976 | A | | 9/1974 | Monser et al. |
| 4,500,887 | A | | 2/1985 | Nester |
| 4,973,925 | A | | 11/1990 | Nusair et al. |
| 5,070,340 | A | | 12/1991 | Diaz |
| 5,185,611 | A | | 2/1993 | Bitter, Jr. |
| 5,208,602 | A | | 5/1993 | Monser et al. |
| 5,248,987 | A | | 9/1993 | Lee |
| 5,428,364 | A | | 6/1995 | Lee et al. |
| 5,519,408 | A | | 5/1996 | Schnetzer |
| 5,557,291 | A | * | 9/1996 | Chu et al. ..... 343/725 |
| 5,786,792 | A | | 7/1998 | Bellus et al. |
| 5,949,382 | A | | 9/1999 | Quan |
| 5,977,911 | A | | 11/1999 | Green et al. |
| 6,208,308 | B1 | | 3/2001 | Lemons |
| 6,271,799 | B1 | | 8/2001 | Rief et al. |
| 6,292,153 | B1 | | 9/2001 | Aiello et al. |

(Continued)

FOREIGN PATENT DOCUMENTS

DE 3215323 A1 1/1982

(Continued)

OTHER PUBLICATIONS

Herscovici, "Extremely Wide-Band Antennas For Wireless Communication;" Presented at 1998 Wireless Symposium; Cushcraft Corp.; two pages.

(Continued)

*Primary Examiner*—Michael C. Wimer
(74) *Attorney, Agent, or Firm*—Daly, Crowley, Mofford & Durkee, LLP

(57) ABSTRACT

A radiator element includes a pair of substrates each having a transition section and a feed surface, each of the substrates is spaced apart from one another. The radiator element further includes a balanced symmetrical feed having a pair of radio frequency (RF) feed lines disposed adjacent to and electromagnetically coupled to the feed surface of one of a corresponding one of the pair of transition sections, and the pair of radio frequency feed lines forms a signal null point adjacent the transition sections.

25 Claims, 7 Drawing Sheets

U.S. PATENT DOCUMENTS

| | | | | |
|---|---|---|---|---|
| 6,300,906 | B1 | 10/2001 | Rawnick et al. | |
| 6,518,931 | B1 | 2/2003 | Sievenpiper | |
| 6,552,691 | B2 | 4/2003 | Mohuchy et al. | |
| 6,771,226 | B1 * | 8/2004 | Dujmovic | 343/797 |

FOREIGN PATENT DOCUMENTS

| | | | |
|---|---|---|---|
| EP | 0 634 808 | A1 | 1/1995 |
| EP | 1 006 609 | A2 | 11/1998 |
| EP | 1 006 609 | A3 | 11/1998 |

OTHER PUBLICATIONS

Schaubert et al.; "Wideband Vivaldi Arrays For Large Aperture Antennas;" A.B. Smolders and M.P. van Haarlem; Perspectives on Radio Astronomy—Technologies for Large Antenna Arrays; Netherlands Foundation for Research in Astronomy 1999; pp. 50-57.

Smolders et al.; "Wide-Band Antenna Element With Integrated Balun;" Presented at the IEEE APS Int. Symposium Atlanta USA 1998; four pages.

York; "Broadband Microwave Power Combiners Using Active Arrays in an Oversized Coasial Waveguide;" Final Report 1997-98 for Micro project 97-217; Sponsored by Hughes Space and Communications, El Segundo, CA, USA; three pages.

Daniel H. Schaubert. Tan-Huat Chio, Wideband Vivaldi Arrays for Large Aperture Antennas, 1999, pp. 59-57, Perspectives on Radio Astronomy—Technologies for Large Antenna Arrays, Netherlands Foundation for Research in Astronomy—1999.

Keith Trott, Bob Cummings, Ronni Cavener, Mark Deluca, Joe Biondi, and Tom Sikina, Wideband Phased Array Radiator, pp. 1-4, 2003 IEEE Phased Array Conference Proceedings, held in Boston, MA. Oct. 14-17, 2003.

PCT/US2004/016336 International Search Report dated Oct. 5, 2004.

DeLuca; "A Broadband Dual Polarized Slotline Feed;" Engineering Project ECE 688: University of Massachusetts/Raytheon: Dec. 16, 2002; 1-37.

DeLuca; "A Broadband Dual Polarized Slotline Feed;" Slide Presentation; 21st Annual Raytheon/UMASS Colloquium; Nov. 13, 2002; pp. 1-22.

* cited by examiner

WIDEBAND PHASED ARRAY RADIATOR

STATEMENTS REGARDING FEDERALLY SPONSORED RESEARCH

This invention was made with government support under Contract No. N-00014-99-C-0314 awarded by the Department of the Navy. The government has certain rights in the invention.

CROSS-REFERENCE TO RELATED APPLICATIONS

Not applicable.

FIELD OF THE INVENTION

This invention relates generally to communications and radar antennas and more particularly to notch radiator elements.

BACKGROUND OF THE INVENTION

In communication systems, radar, direction finding and other broadband multifunction systems, having limited aperture space, it is often desirable to efficiently couple a radio frequency transmitter and receiver to an antenna having an array of broadband radiator elements.

Conventional known broadband phased array radiators generally suffer from significant polarization degradation at large scan angles in the diagonal scan planes. This limitation can force a polarization weighting network to heavily weight a single polarization. This weighting results in the transmit array having poor antenna radiation efficiency because the unweighted polarization signal must supply most of the antenna Effective Isotropic Radiated Power (EIRP) of the transmitted signal.

Conventional broadband phased array radiators generally use a simple, but asymmetrical feed or similar arrangement. Since a conventional broadband radiator is capable of supporting a relatively large set of higher-order propagation modes, the feed region acts as the launcher for these high-order propagation mode signals. The feed is essentially the mode selector or filter. When the feed incorporates asymmetry in the orientation of launched fields or the physical symmetry of the feed region, higher-order modes are excited. Those modes then propagate to the aperture. The higher-order modes cause problems in the radiator performance. Since higher-order modes propagate at differing phase velocities, the field at the aperture is the superposition of multiply excited modes. The result is sharp deviations from uniform magnitude and phase in the unit cell fields. The fundamental mode aperture excitation is relatively simple, usually resulting from the TEO, mode, with a cosine distribution in the E-plane and uniform field in the H-plane. Significant deviations from the fundamental mode result from the excited higher-order modes, and the higher order modes are responsible for the radiating element's resonance and scan blindness. Another effect produced by the presence of higher-order mode propagation in the asymmetrically-fed wideband radiator is cross-polarization. Particularly in the diagonal planes, many of the higher-order modes include an asymmetry that excites the cross-polarized field. The cross-polarized field is in turn responsible for an unbalanced weighting in the antenna's polarization weighting network, which can be responsible for low array transmit power efficiency.

There is a need for broadband radiating elements used in phased array antennas for communications, radar and electronic warfare systems with reduced numbers of apertures required for multiple applications. In these applications, minimum bandwidths of 3:1 are required, but 10:1 bandwidths or greater are desired. The radiating element must be capable of transmitting and receiving vertical and/or horizontal linear polarization, right-hand and/or left-hand circular polarization or a combination of each depending on the application and the number of radiating beams required. It is desireable for the foot print of the radiator to be as small as possible and to fit within the unit cell of the array to reduce the radiator profile, weight and cost.

Prior attempts to provide broadband radiators have used bulky radiators and feed structures without co-located (coincident) radiation pattern phase centers. The conventional radiators also typically have relatively poor cross-polarization isolation characteristics in the diagonal planes. In an attempt to solve these problems, a conventional quad-notch type radiator having a shape approximately one half the typical size of a full sized notch radiator ($0.2\lambda_L$ vs $0.4\lambda_L$, where $\lambda_L$ is the wavelength for the low frequency) has been adapted to include four separate radiators within a unit cell. This arrangement allows for a virtual co-located phase center for each unit cell, but requires a complicated feed structure. The typical quad-notch radiator requires a separate feed/balun for each of the four radiators within the unit cell plus another set of feed networks to combine the pair of radiators used for each polarization. Previously fabricated notch radiators used microstrip or stripline circuits feeding a slotline for the RF signal input and output of the radiating element. Unfortunately these conventional types of feed structures allow multiple signal propagation modes to be generated within each unit cell area causing a reduction in the cross polarization isolation levels, especially in the diagonal planes.

It would, therefore, be desirable to provide a broadband phased array radiator having high polarization purity and a low mismatch loss. It would be further desirable to provide a radiator element having a low profile and a broad bandwidth.

SUMMARY OF THE INVENTION

In accordance with the present invention, a radiator element includes a pair of substrates each having a transition section and a feed surface, each of the substrates is spaced apart from one another. The radiator element further includes a balanced symmetrical feed having a pair of radio frequency (RF) feed lines disposed adjacent to and electromagnetically coupled to the feed surface of one of a corresponding pair of transition sections, and the pair of radio frequency feed lines forms a signal null point adjacent the transition sections.

With such an arrangement, a broadband phased array radiator provides high polarization purity and a low mismatch loss. An array of the radiator elements provides a high polarization purity and low loss phased array antenna having greater than a 60° conical scan volume and a 10:1 wideband performance bandwidth with a light-weight, low-cost fabrication.

In accordance with a further aspect of the present invention, the balanced symmetrical feed further includes a housing having a plurality of sidewalls which form a cavity. Each of the pair of feed lines is each disposed on a pair of opposing sidewalls and includes a microstrip transmission line. With such an arrangement, the balanced symmetrical radiator feed produces a relatively well matched broadband radiation signal having relatively good cross-polarization isolation for a dually-orthogonal fed radiator. The balanced symmetrical feed is both physically symmetrical and is fed with symmetrical Transverse Electric Mode (TEM) fields. Important features of the feed are the below-cutoff waveguide termination for the flared notch geometry, a symmetrical dual-polarized TEM field feed region, and a broadband balun that generates the symmetrical fields.

In a further embodiment, a set of four fins provide the substrates for each unit cell and are symmetric about the center feed. This arrangement allows for a co-located (coincident) radiation pattern phase center such that for any polarization transmitted or received by an array aperture, the phase center will not vary.

In accordance with a still further aspect of the present invention, the radiator element includes substrates having heights of less than approximately $0.25\lambda_L$, where $\lambda_L$ refers to the wavelength of the low end of a range of operating wavelengths. With such an arrangement, the electrically short crossed notch radiating fins for the radiator elements are combined with a raised balanced symmetrical feed network above an open cavity to provide broadband operation and a low profile. The balanced symmetrical feed network feeding the crossed notch radiating fins provide a co-located (coincident) radiation pattern phase center and simultaneous dual linear polarized outputs provide multiple polarization modes on receive or transmit. The electrically short crossed notch radiating fins provide for low cross-polarization in the principal, intercardinal and diagonal planes and the short fins form a reactively coupled antenna with a low profile.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Before describing the antenna system of the present invention, it should be noted that reference is sometimes made herein to an array antenna having a particular array shape (e.g. a planar array). One of ordinary skill in the art will appreciate of course that the techniques described herein are applicable to various sizes and shapes of array antennas. It should thus be noted that although the description provided herein below describes the inventive concepts in the context of a rectangular array antenna, those of ordinary skill in the art will appreciate that the concepts equally apply to other sizes and shapes of array antennas including, but not limited to, arbitrary shaped planar array antennas as well as cylindrical, conical, spherical and arbitrary shaped conformal array antennas.

Reference is also sometimes made herein to the array antenna including a radiating element of a particular size and shape. For example, one type of radiating element is a so-called notch element having a tapered shape and a size compatible with operation over a particular frequency range (e.g. 2–18 GHz). Those of ordinary skill in the art will recognize, of course that other shapes of antenna elements may also be used and that the size of one or more radiating elements may be selected for operation over any frequency range in the RF frequency range (e.g. any frequency in the range from below 1 GHz to above 50 GHz).

Also, reference is sometimes made herein to generation of an antenna beam having a particular shape or beamwidth. Those of ordinary skill in the art will appreciate, of course, that antenna beams having other shapes and widths may also be used and may be provided using known techniques such as by inclusion of amplitude and phase adjustment circuits into appropriate locations in an antenna feed circuit.

Figure 1:
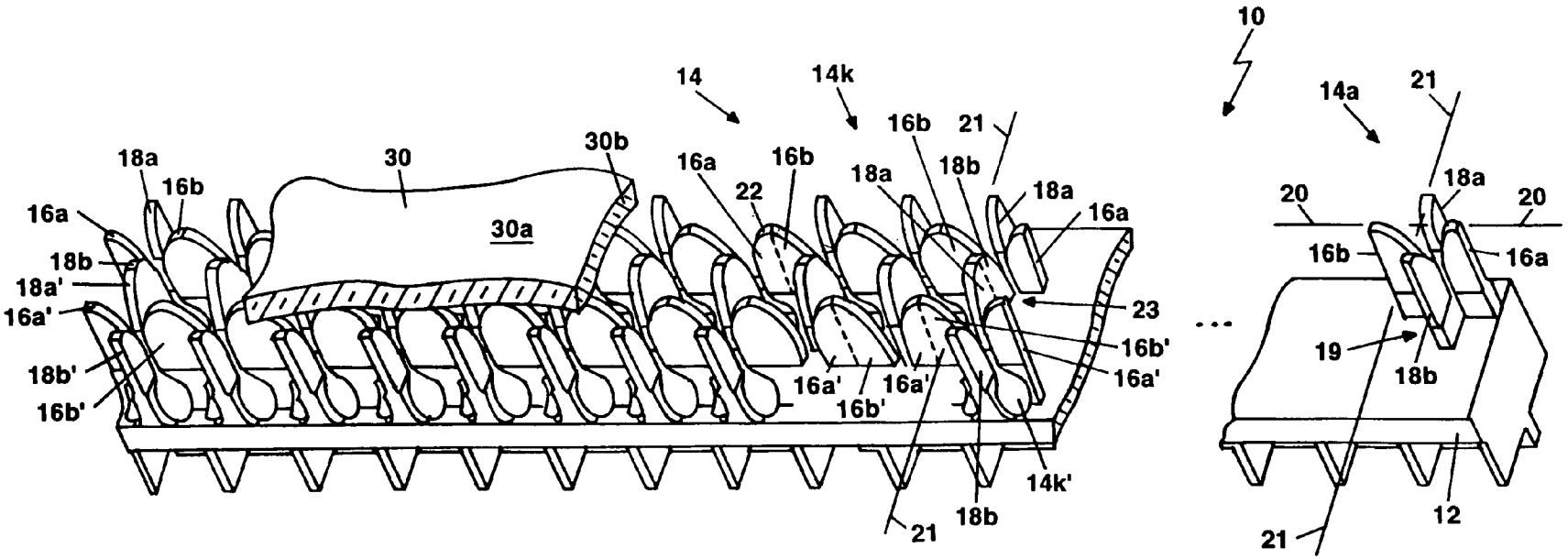
FIG. 1 is an isometric view of an array of notch radiators provided from a plurality of fin elements.

Referring now to FIG. 1, an exemplary wideband antenna 10 according to the invention includes a cavity plate 12 and an array of notch antenna elements generally denoted 14. Each of the notch antenna elements 14 is provided from a so-called "unit cell" disposed on the cavity plate 12. Stated differently, each unit cell forms a notch antenna element 14. It should be appreciated that, for clarity, only a portion of the antenna 10 corresponding to a two by sixteen linear array of notch antenna elements 14 (or unit cells 14) is shown in FIG. 1.

Taking a unit cell 14*a* as representative of each of the unit cells 14, unit cell 14*a* is provided from four fin-shaped members 16*a*, 16*b*, 18*a*, 18*b* each of which is shaded in FIG. 1 to facilitate viewing thereof Fin-shaped members 16*a*, 16*b*, 18*a*, 18*b* are disposed on a feed structure 19 over a cavity (not visible in FIG. 1) in the cavity plate 12 to form the notch antenna element 14*a*. The feed structure 19 will be described below in conjunction with FIGS. 4 and 4A. It should be appreciated, however, that a variety of different types of feed structures can be used and several possible feed structures will be described below in conjunction with FIGS. 2–4A.

As can be seen in FIG. 1, members 16*a*, 16*b* are disposed along a first axis 20 and members 18*a*, 18*b* are disposed along a second axis 21 which is orthogonal to the first axis 20. Thus the members 16*a*, 16*b* are substantially orthogonal to the members 18*a*, 18*b*.

By disposing the members 16*a*, 16*b* orthogonal to members 18*a*, 18*b* in each unit cell, each unit cell is responsive to orthogonally directed electric field polarizations. That is, by disposing one set of members (e.g. members 16*a*, 16*b*) in one polarization direction and disposing a second set of members (e.g. members 18*a*, 18*b*) in the orthogonal polarization direction, an antenna which is responsive to signals having any polarization is provided.

In this particular example, the unit cells 14 are disposed in a regular pattern which here corresponds to a rectangular grid pattern. Those of ordinary skill in the art will appreciate, of course, that the unit cells 14 need not all be disposed in a regular pattern. In some applications, it may be desirable or necessary to dispose the unit cells 14 in such a way that the orthogonal elements 16*a*, 16*b*, 18*a*, 18*b* of each individual unit cell are not aligned between every unit cell 14. Thus, although shown as a rectangular lattice of unit cells 14, it will be appreciated by those of ordinary skill in the art, that the antenna 10 could include but is not limited to a square or triangular lattice of unit cells 14 and that each of the unit cells can be rotated at different angles with respect to the lattice pattern.

In one embodiment, to facilitate the manufacturing process, at least some of the fin-shaped members 16*a* and 16*b* can be manufactured as "back-to-back" fin-shaped members as illustrated by member 22. Likewise, the fin-shaped members 18*a* and 18*b* can also be manufactured as "back-to-back" the fin shaped members as illustrated by member 23. Thus, as can be seen in unit cells 14*k* and 14*k*', each half of a back-to-back fin-shaped member forms a portion of two different notch elements.

The plurality of fins 16*a*, 16*b* (generally referred to as fins 16) form a first grid pattern and the plurality of fins 18*a*, 18*b* (generally referred to as fins 18) form a second grid pattern. As mentioned above, in the embodiment of FIG. 1, the orientation of each of the fins 16 is substantially orthogonal to the orientation of each of the fins 18.

The fins 16*a*, 16*b* and 18*a*, 18*b* of each radiator element 14 form a tapered slot from which RF signals are launched for each unit cell 14 when fed by a balanced symmetrical feed circuit (described in detail in conjunction with FIGS. 2–4A below).

By utilizing symmetric back-to-back fin-shaped members 16, 18 and a balanced feed, each unit cell 14 is symmetric. The phase center for each polarization is concentric within each unit cell. This allows the antenna 10 to be provided as a symmetric antenna.

This is in contrast to prior art notch antennas in which phase centers for each polarization are slightly displaced.

It should be noted that reference is sometimes made herein to antenna 10 transmitting signals. However, one of ordinary skill in the art will appreciate that antenna 10 is equally well adapted to receive signals. As with a conventional antenna, the phase relationship between the various signals is maintained by the system in which the antenna is used.

In one embodiment, the fins 16, 18 are provided from an electrically conductive material. In one embodiment, the fins 16, 18 are provided from solid metal. In some embodiments, the metal can be plated to provide a plurality of plated metal fins. In an alternate embodiment, the fins 16, 18 are provided from a nonconductive material having a conductive material disposed thereover. Thus, the fin structures 16, 18 can be provided from either a plastic material or a dielectric material having a metalized layer disposed thereover.

In operation; RF signals are fed to each unit cell 14 by the balanced symmetrical feed 19. The RF signal radiates from the unit cells 14 and forms a beam, the boresight of which is orthogonal to cavity plate 12 in a direction away from cavity plate 12. The pair of fins 16, 18 can be thought of as two halves making up a dipole. Thus, the signals fed to each substrate are ordinarily 180° out of phase. The radiated signals from antenna 10 exhibit a high degree of polarization purity and have greater signal power levels which approach the theoretical limits of antenna gain.

In one embodiment, the notch element taper of each transition section of tapered slot formed by the fins 16*a*, 16*b* is described as a series of points in a two-dimensional plane as shown in tabular form in Table I.

TABLE I

Notch Taper Values

| z(inches) | x(inches) |
|---|---|
| 0 | .1126 |
| .025 | .112 |
| .038 | .110 |
| .050 | .108 |
| .063 | .016 |
| .075 | .103 |
| .088 | .1007 |
| .100 | .098 |
| .112 | .094 |
| .125 | .0896 |
| .138 | .0845 |
| .150 | .079 |
| .163 | .071 |
| .175 | .063 |
| .188 | .056 |
| .200 | .0495 |
| .212 | .0435 |
| .225 | .0375 |
| .238 | .030 |

It should be appreciated, of course that the size and shape of the fin-shaped elements 16, 18 (or conversely, the size of the slot formed by the fin-shaped elements 16, 18) can be selected in accordance with a variety of factors including but not limited to the desired operating frequency range. In general, however, a fin-shaped member which is relatively short with relatively fast opening rate provides a higher degree of cross-polarization isolation at relatively wide scan angles compared with the degree of cross-polarization isolation provided from a fin-shaped member which is relatively long. It should be appreciated, however that if the fin-shaped member is too short, low frequency H-plane performance can be degraded.

Also, a relatively long fin-shaped element (with any opening rate) can result in an antenna characteristic having VSWR ripple and relatively poor cross-polarization performance.

The antenna 10 also includes a matching sheet 30 disposed over the elements 14. It should be understood that in FIG. 1 portions of the matching sheet 30 have been removed to reveal the elements 14. In practice, the matching sheet 30 will be disposed over all elements 14 and integrated with the antenna 10.

The matching sheet 30 has first and second surfaces 30*a*, 30*b* with surface 30*b* preferably disposed close to but not necessarily touching the fin-shaped elements 16, 18. From a structural perspective, it may be preferred to having the matching sheet 30 physically touch the fin-shaped members. Thus, the precise spacing of the second surface 30*b* from the fin-shaped members can be used as a design parameter selected to provide a desired antenna performance characteristic or to provide the antenna having a desired structural characteristic.

The thickness, relative dielectric constant and loss characteristics of the matching sheet can be selected to provide the antenna 10 having desired electrical characteristics. In one embodiment, the matching sheet 30 is provided as a sheet of commercially available PPFT (i.e. Teflon) having a thickness of about 50 mils.

Although the matching sheet 30 is here shown as a single layer structure, in alternate embodiments, it may be desirable to provide the matching sheet 30 as multiple layer structure. It may be desirable to use multiple layers for structural or electrical reasons. For example, a relatively stiff layer can be added for structural support. Or, layers having different relative dielectric constants can be combined to such that the matching sheet 30 is provided having a particular electrical impedance characteristic.

In one application, it may be desirable to utilize multiple layers to provide the matching sheet 30 as an integrated radome/matching structure 30.

It should thus be appreciated that making fins shorter improves the cross-polarization isolation characteristic of the antenna. It should also be appreciated that using a radome or wide angle matching (WAIM) sheet (e.g. matching sheet 30) enables the use of even shorter fins which further improves the cross-polarization isolation since the radome/matching sheet makes the fins appear electrically longer.

Figure 2:
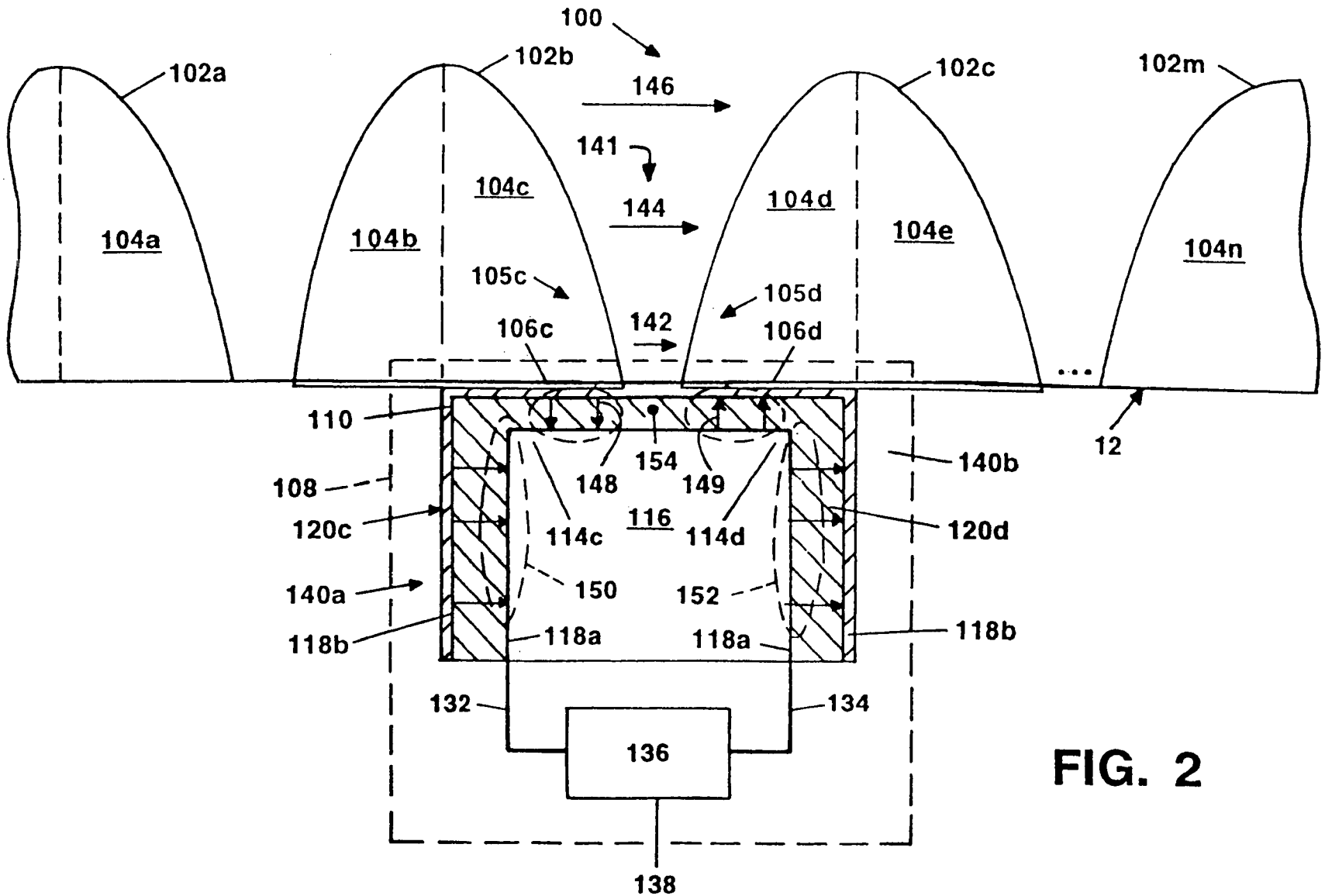
FIG. 2 is a cross sectional view of a portion of a unit cell of an alternate embodiment of the radiator array of FIG. 1 including a balanced symmetrical feed circuit.

Referring now to FIG. 2, a radiator element 100 which is similar to the radiator element formed by fin-shaped members 16*a*, 16*b* of FIG. 1, is one of a plurality of radiators elements 100 forming an antenna array according to the invention. The radiator element 100 which forms one-half of a unit cell, similar to the unit cell 14 (FIG. 1), includes a pair of substrates 104*c* and 104*d* (generally referred to as substrates 104) which are provided by separate fins 102*b* and 102*c* respectively. It should be noted that substrates 104*c*, 104*d* correspond to the fin-shaped members 16*a*, 16*b* (or 18*a*, 18*b*) of FIG. 1 while fins 102*a*, 102*b* correspond to the back-to-back fin-shaped elements discussed above in conjunction with FIG. 1. The fins 102*b* and 102*c* are disposed on the cavity plate 12 (FIG. 1). Fin 102*b* also includes substrate 104*b* which forms another radiator element in conjunction with substrate 104*a* of fin 102*a*. Each substrate 104*c* and 104*d* has a planar feed which includes a feed surface 106*c* and 106*d* and a transition section 105*c* and 105*d* (generally referred to as transition sections 105), respectively. The radiator element 100 further includes a balanced symmetrical feed circuit 108 (also referred to as balanced symmetrical feed 108) which is electromagnetically coupled to the transition sections 105.

The balanced symmetrical feed 108 includes a dielectric 110 having a cavity 116 with the dielectric having internal surfaces 118*a* and external surfaces 118*b*. A metalization layer 114*c* is disposed on the internal surface 118*a* and a metalization layer 120*c* is disposed on the external surface 118*b*. In a similar manner, a metalization layer 114*d* is disposed on the internal surface 118*a* and a metalization layer 120*d* is disposed on the external surface 118*b*. It should be appreciated by one of skill in the art that the metalization layer 114*c* (also referred to as feed line or RF feed line 114*c*) and the metalization layer 120*c* (also referred to as ground plane 120*c*) interact as microstrip circuitry 140*a* wherein the ground plane 120*c* provides the ground circuitry and the feed line 114*c* provides the signal circuitry for the microstrip circuitry 140*a*. Furthermore, the metalization layer 114*d* (also referred to as feed line or RF feed line 114*d*) and the metalization layer 120*d* (also referred to as ground plane 120*d*) interact as microstrip circuitry 140*b* wherein the ground plane 120*d* provides the ground circuitry and the feed line 114*d* provides the signal circuitry for the microstrip circuitry 140*b*.

The balanced symmetrical feed 108 further includes a balanced-unbalanced (balun) feed 136 having an RF signal line 138 and first RF signal output line 132 and a second RF signal output line 134. The first RF signal output line 132 is coupled to the feed line 114*c* and the second RF signal output line 134 is coupled to the feed line 114*d*. It should be appreciated two 180° baluns 136 are required for the unit cell similar to unit cell 14, one balun to feed the radiator elements for each polarization. Only one balun 136 is shown for clarity. The baluns 136 are required for proper operation of the radiator element 100 and provide simultaneous dual polarized signals at the output ports with relatively good isolation. The baluns 136 can be provided as part of the balanced symmetrical feed 108 or as separate components, depending on the power handling and mission requirements. A first signal output of the balun 136 is connected to the feed line 114*c* and the second RF signal output of the balun 136 is connected to the feed line 114*d*, and the signals propagate along the microstrip circuitry 140*a* and 140*b*, respectively, and meet at signal null point 154 with a phase relationship 180 degrees out of phase as described further herein after. It should be noted that substrate 104*c* includes a feed surface 106*c* and substrate 104*d* includes a feed surface 106*d* that is diposed along metalization layer 120*c* and 120*d*, respectively.

The radiator element 100 provides a co-located (coincident) radiation pattern phase center for each polarization signal being transmitted or received. The radiator element 100 provides cross polarization isolation levels in the principal plane and in the diagonal planes to allow scanning beams out to 60°.

In operations RF signals are fed differentially from the balun 136 to the signal output line 132 and the signal output line 134, here at a phase difference of 180 degrees. The RF signals are coupled to microstrip circuitry 140*a* and 140*b*, respectively and propagate along the microstrip circuitry meeting at signal null point 154 at a phase difference of 180 degrees where the signals are destructively combined to zero at the feed point. The RF signals propagating along the microstrip circuitry 140*a* and 140*b* are coupled to the slot 141 and radiate or "are launched" from transition sections 105*c* and 105*d*. These signals form a beam, the boresight of which is orthogonal to the cavity plate 12 in the direction away from the cavity 116. The RF signal line 138 is coupled to receive and transmit circuits as is known in the art wing a circulator (not shown) or a transmit/receive switch (not shown).

Field lines 142, 144, 146 illustrate the electric field geometry for radiator element 100. In the region around metalization layer 120*c*, the electric field lines 150 extend from the metalization layer 120*c* to the feed line 114*c*. In the region around metalization layer 120*d* the electric field lines 152 extend from the feed line 114*d* to the metalization layer 120*d*. In the region around feed surface 106*c*, the electric field lines 148 extend from the metalization layer 120*c* to the feed line 114*c*. In the region around feed surface 106*d*, the electric field lines 149 extend from the feed line 114*d* to the metalization layer 120*d*. At a field point 154 (also referred to as a signal null point 154), the electric field lines 148 and 149 from the feed lines 114*c* and 114*d* substantially cancel each other forming the signal null point 154. The arrangement of feed lines 114*c* and 114*d* and transition sections 105*c* and 105*d* reduce the excitation of asymmetric modes which increase loss mismatch and cross polarization. Here, the launched TEM modes shown as electric field lines 142 are transformed through intermediate electric field lines 144 having Floquet modes shown as field lines 146. Received signals initially having Floquet modes collapse into balanced TEM modes.

The pair of substrates 104*c* and 104*d* and corresponding transition sections 105*c* and 105*d* can be thought of as two halves making up a dipole. Thus, the signals on feed lines 114*c* and 114*d* will ordinarily be 180° out of phase. Likewise, the signals on each of the feed lines of the orthogonal transitions (not shown) forming the unit cell similar to the unit cell 14 (FIG. 1) will be 180° out of phase. As in a conventional dipole array, the relative phase of the signals at the transition sections 105*c* and 105*d* will determine the polarization of the signals transmitted by the radiator element 100.

In an alternative embodiment, the metalization layer 120*c* and 120*d* along the feed surface 106*c* and 106*d*, respectively, can be omitted with the metalization layer 120*c* connected to the feed surface 106*c* where they intersect and the metalization layer 120*d* connected to the surface 106*d* where they intersect. In this alternative embodiment, the feed surface 106*c* and 106*d* provide the ground layer for the microstrip circuitry 140*a* and 140*b*, respectively along the bottom of the substrate 104*c* and 104*d*, respectively.

In another alternate embodiment, amplifiers (not shown) are coupled between the balun 136 signal output lines 132 and 134 and the transmission feeds 114*c* and 114*d* respectively. In this alternate embodiment, most of the losses associated with the balun 136 are behind the amplifiers.

Figure 3:
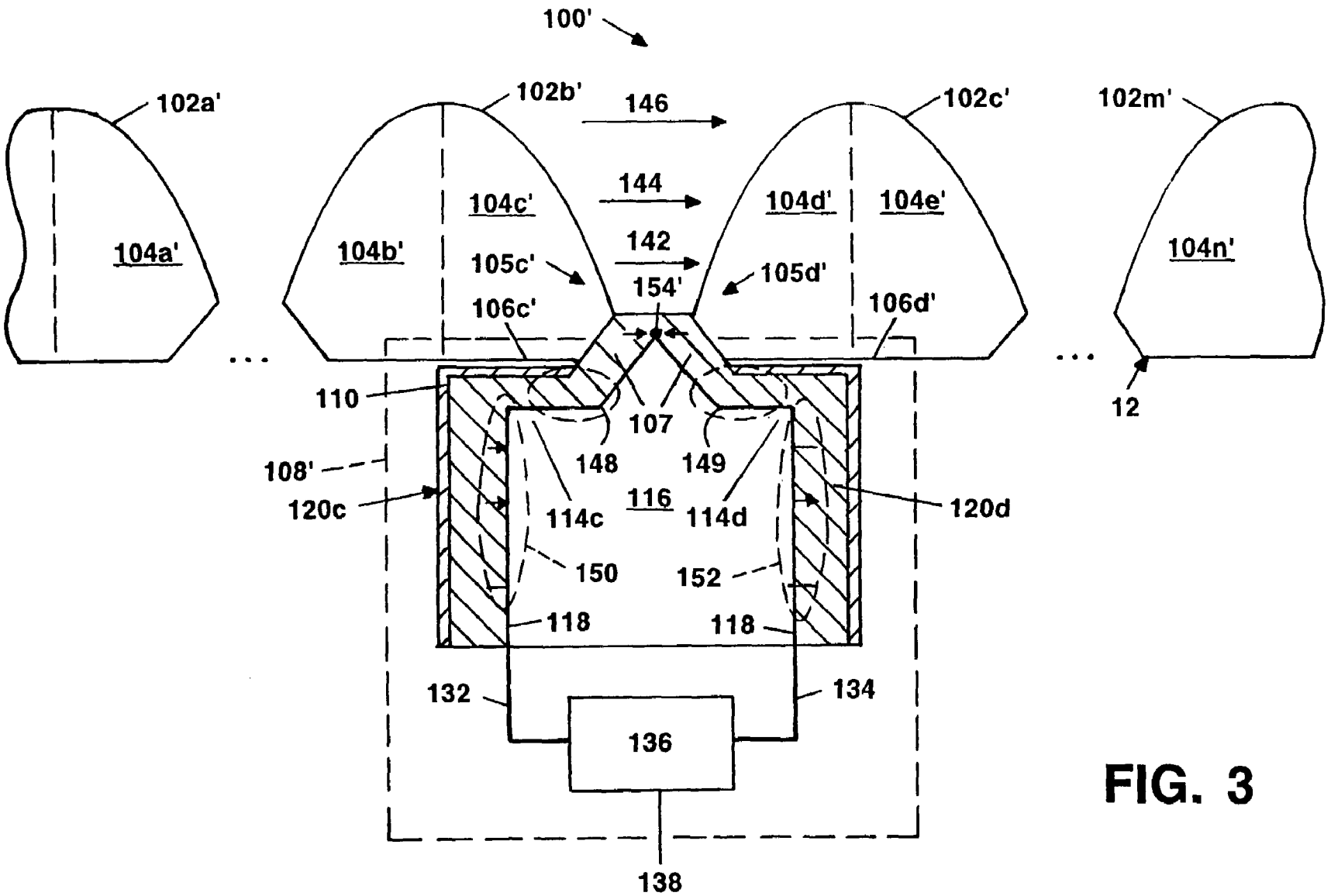
FIG. 3 is a cross sectional view of a portion of a unit cell of the radiator array of FIG. 1 including a raised balanced symmetrical feed circuit.
Figure 3A:
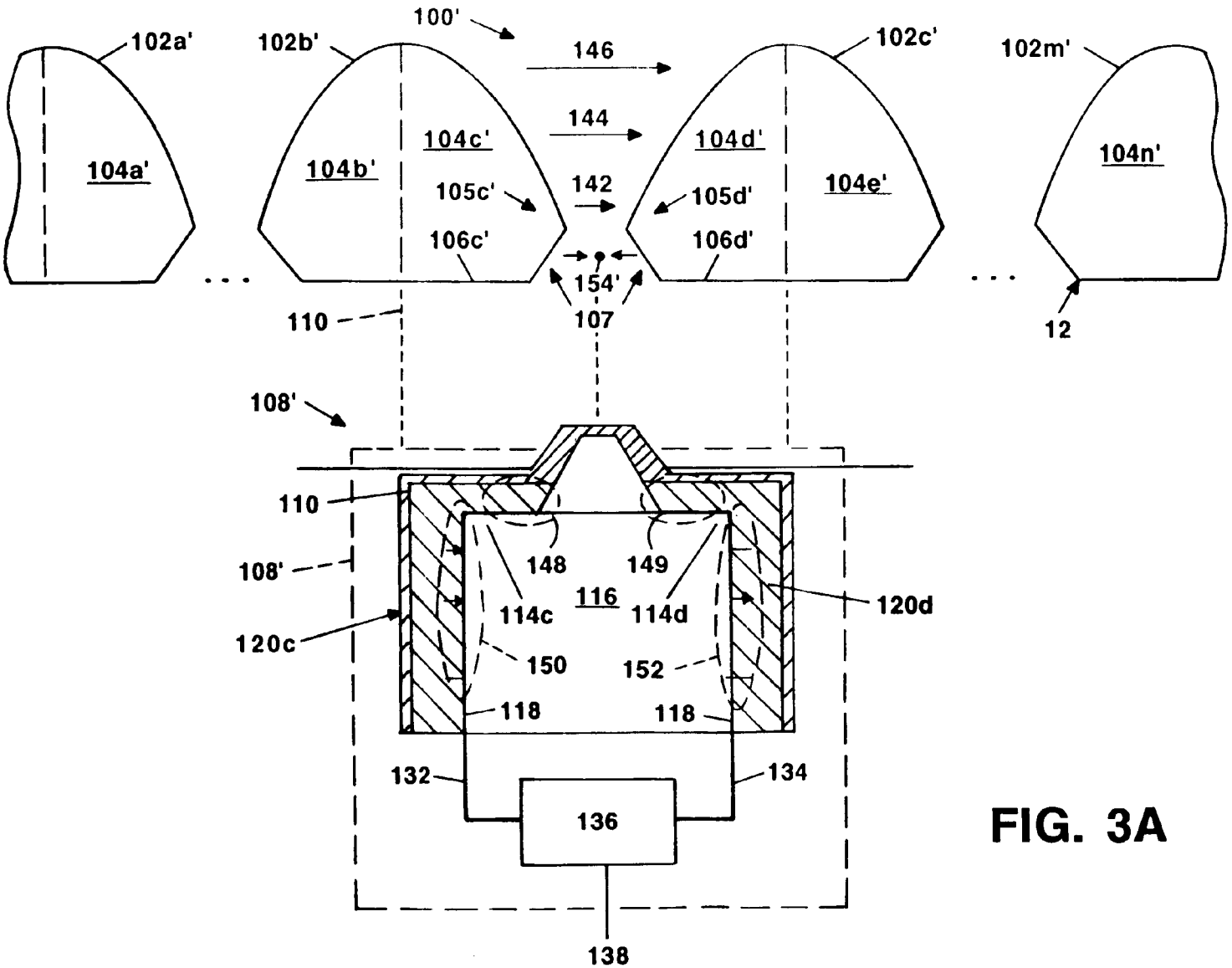
FIG. 3A is an exploded cross sectional view of FIG. 3 illustrating the coupling of a portion of a unit cell to the raised balanced symmetrical feed circuit.

Referring now to FIGS. 3 and 3A in which like elements in FIGS. 2, 3 and 3A are provided having like reference designations, a radiator element 100' (also referred to as an electrically short crossed notch radiator element 100') includes a pair of substrates 104*c*' and 104*d*' (generally referred to as substrates 104'). It should be noted that substrates 104*c*', 104*d*' correspond to the fin-shaped members 16*a*, 16*b* (or 18*a*, 18*b*) of FIG. 1. Each substrate 104*c*' and 104*d*' has a pyramidal feed which includes a feed surface 106*c*' and 106*d*' and a transition section 105*c*' and 105*d*' (generally referred to as transition sections 105') respectively. The transition sections 105' and feed surfaces 106' differ from the corresponding transition sections 105 and feed surfaces 106 of FIG. 2 in that the transition sections 105' and feed surfaces 106' include notched ends 107 forming an arch. The feed surfaces 106*c*' and 106*d*' are coupled with a similarly shaped balanced symmetrical feed 108' (also referred to as a raised balanced symmetrical feed).

The transition section 105' has improved impedance transfer into space. It will be appreciated by those of ordinary skill in the art, the transition sections 105' can have an arbitrary shape, for example, the arch formed by notched ends 107 can be shaped differently to affect the transfer impedance to provide a better impedance match. The taper of the transition sections 105' can be adjusted using known methods to match the impedance of the fifty ohm feed to free space.

More specifically, the balanced symmetrical feed 108' includes a dielectric 110 having a cavity 116 with the dielectric having internal surfaces 118*a* and external surfaces 118*b*. A metalization layer 114*c* is disposed on the internal surface 118*a* and a metalization layer 120*c* is disposed on the external surface 118*b*. In a similar manner, a metalization layer 114*d* is disposed on the internal surface 118*a* and a metalization layer 120*d* is disposed on the external surface 118*b*. It should be appreciated by one of skill in the art that the RF feed line 114*c* and the metalization layer 120*c* (also referred to as ground plane 120*c*) interact as microstrip circuitry 140*a* wherein the ground plane 120*c* provides the ground circuitry and the feed line 114*c* provides the signal circuitry for the microstrip circuitry 140*a*. Furthermore, the or RF feed line 114*d* and the metalization layer 120*c* (also referred to as ground plane 120*d*) interact as microstrip circuitry 140*b* wherein the ground plane 120*d* provides the ground circuitry and the feed line 114*d* provides the signal circuitry for the microstrip circuitry 140*b*.

The balanced symmetrical feed 108' further includes a balun 136 similar to balun 136 of FIG.2. A first signal output of the balun 136 is connected to the feed line 114*c* and the second RF signal output of the balun 136 is connected to the feed line 114*d* wherein the signals propagate along the microstrip circuitry 140*a* and 140*b*, respectively, and meet at signal null point 154' with a phase relationship 180 degrees out of phase. Again, it should be noted that substrate 104*c* includes a feed surface 106*c* and substrate 104*d* includes a feed surface 106*d* that is diposed along metalization layer 120*c* and 120*d*, respectively. The radiator element 100' provides a co-located (coincident) radiation pattern phase center for each polarization signal being transmitted or received. The radiator element 100 provides cross polarization isolation levels in the principal plane and in the diagonal planes to allow scanning beams approaching 600.

In operation, RF signals are fed differentially from the balun 136 to the signal output line 132 and the signal output 134, here at a phase difference of 180 degrees. The signals are coupled to microstrip circuitry 140*a* and 140*b*, respectively and propagate along the microstrip circuitry meeting at signal null point 154' at a phase difference of 180 degrees where the signals are destructively combined to zero at the feed point. The RF signals propagating along the microstrip circuitry 140*a* and 140*b* are coupled to the slot 141 and radiate or "are launched" from transition sections 105*c*' and 105*d*'. These signals form a beam, the boresight of which is orthogonal to the cavity plate 12 in the direction away from cavity 116. The RF signal line 138 is coupled to receive and transmit circuits as is known in the art using a circulator (not shown) or a transmit/receive switch (not shown).

Field lines 142, 144, 146 illustrate the electric field geometry for radiator element 100'. In the region around metalization layer 120*c*, the electric field lines 150 extend from the metalization layer 120*c* to the feed line 114*c*. In the region around metalization layer 120*d* the electric field lines 152 extend from the feed line 114*d* to the metalization layer 120*d*. In the region around feed surface 106*c*', the electric field lines 148 extend from the metalization layer 120*c* to the feed line 114*c*. In the region around feed surface 106*d*', the electric field lines 149 extend from the feed line 114*d* to the metalization layer 120*d*. At a signal null point 154', the RF field lines from the RF feed lines 114*c* and 114*d* substantially cancel each other forming a signal null point 154'. The arrangement of RF feed lines 114*c* and 114*d* and transition sections 105*c*' and 105*d*' reduce the excitation of asymmetric modes which increase loss mismatch and cross polarization. Here, the launched TEM modes shown as electric field lines 142 are transformed through intermediate electric field lines 144 having Floquet modes shown as field lines 146. Received signals initially having Floquet modes collapse into balanced TEM modes.

In one embodiment the radiator element 100' includes fins 102*b*' and 102*c*' (generally referred to as fins 102') having heights of less than $0.25\lambda_L$, where $\lambda_L$ refers to the wavelength of the low end of a range of operating wavelengths. Although in theory, radiator elements this short should stop radiating or have degraded performance, it was found the shorter elements actually provided better performance. The fins 102*b*' and 102*c*' are provided with a shape which matches the impedance of the balanced symmetrical feed 108' circuit to free space. The shape can be determined empirically or by mathematical techniques known in the art. The electrically short crossed notch radiator element 100' includes portions of two pairs of metal fins 102*b*' and 102*c*' disposed over an open cavity 116 provided by the balanced symmetrical feed 108'. Each pair of metal fins 102' is disposed orthogonal to the other pair of metal fins (not shown).

In one embodiment, the cavity 116 wall thickness is 0.030 inches. This wall thickness provides sufficient strength to the array structure and is the same width as the radiator fins 102' used in the aperture. Radiator fin 102' length, measured from the feed point in the throat of the crossed fins 102' to the top of the fin is 0.250 inches without a radome (not shown) and operating at a frequency of 7–21 GHz. The length may possibly be even shorter with a radome/matching structure (e.g. matching sheet 30 in FIG. 1). It should be appreciated the impedance characteristics of the radome affect the signal transition into free space and could enable shorter fins 102'. It will be appreciated by those of ordinary skill in the art that the cavity 116 wall dimensions and the fin 102' dimensions can be adjusted for different operating frequency ranges.

The theory of operation behind the electrically short crossed notch radiator element 100' is based on the Marchand Junction Principle. The original Marchand balun was designed as a coax to balanced transmission line converter. The Marchand balun converts the signal from an unbalanced TEM mode on a first end of the coaxial line to a balanced mode on a second end. The conversion takes place at a virtual junction where the fields in one mode (TEM) collapse and go to zero and are reformed on the other side as the balanced mode with very little loss due to the conservation of energy. Mode field cancellation occurs when the RF field on the transmission line is split into two signals, 180 degrees out-of-phase from each other and then combined together at a virtual junction. This is accomplished by splitting the signal at a junction equidistant from two opposing boundary conditions, such as open and short circuits. For the electrically short crossed notch radiator element 100', the input for one polarization is a pair of microstrip lines provided by feed surfaces 106' and notched ends 107 (operating in TEM mode) which feed one side with a zero degree signal and the other side with a 180 degrees out-of-phase signal. These signals come together at a virtual junction signal null point 154', also referred to as the throat of the electrically short crossed notch radiator element 100'.

At the signal null point 154', the fields collapse and go to zero and are reformed on the other side in the balanced slotline of the electrically short crossed notch radiator element 100' and propagate outward to free space. The two opposing boundary conditions for the electrically short crossed notch radiator element 100' are the shorted cavity beneath the element 100' and the open circuit formed at the tip (disposed near electric field lines 146) of each pair of the radiator fins 102*b*' and 102*c*'. The operation of the virtual junction is reciprocal for both transmit and receive.

In one embodiment the short radiating fins and cavity are molded as a single unit to provide close tolerances at the gap where the four crossed fins 102' meet. The balanced symmetrical feed circuit 108' can also be molded to fit into the cavity area below the fins 102' further simplifing the assembly. For receive applications balun circuits 136 are included in the balanced symmetrical feed circuit 108' further reducing the profile for the array. The short crossed notch radiator element 100' represents a significant advance over conventional wideband notch radiators by providing broad bandwidth in a relatively smaller profile using printed cirucit board technology and relatively short radiator elements 100'. The radiator elements 100' use co-located (coincident) radiation pattern phase centers which are advantageous for certain applications and the physically relatively short profile. Other wideband notch radiators, including the more complex quad notch radiator, do not have the wide angle diagonal plane cross-polarization isolation characteristics of the electrically short crossed notch radiator element 100'. The combination of the balanced symmetrical feed circuit 108' and the short fins 102' provides a reactively coupled notch antenna. The reactively coupled notch enables the use of shorter fin lengths, thereby improving the cross-polarization isolation. The length of the fins 102' directly impacts the wideband performance and the cross-polarization isolation levels acheived.

In another embodiment, the fins 102' are much (previous discussion page 15 line 6 had less than . . . guess this should be much shorter) shorter than approximately $0.25\lambda_L$, where $\lambda_L$ refers to the wavelength of the low end of a range of operating wavelengths and the broadband dual polarized electrically short crossed notch antenna radiator element 100' transmits and receives signals with selective polarization with co-located (coincident) radiation pattern phase centers having excellent cross-polarization isolation and axial ratio in the principal and diagonal planes. When coupled with the inventive balanced symmetrical feed arrangement, the radiator element 100' provides a low profile and broad bandwidth. In this embodiment, short fins 102' also provide a reactively coupled notch antenna. The length of the prior art fins was determined to be the main source of the poor cross-polarization isolation performance in the diagonal planes. It was determined that both the diagonal plane co-polarization and diagonal plane cross-polarization levels varied as a function of the electrical length of the fin. A further advantage of the electrically short crossed notch radiator fins used in an array environment is the high cross polarization isolation levels achieved in the diagonal planes out past ±fifty degrees of scan as compared to current notch radiator designs which can scan out to only ±twenty degrees.

Figure 4:
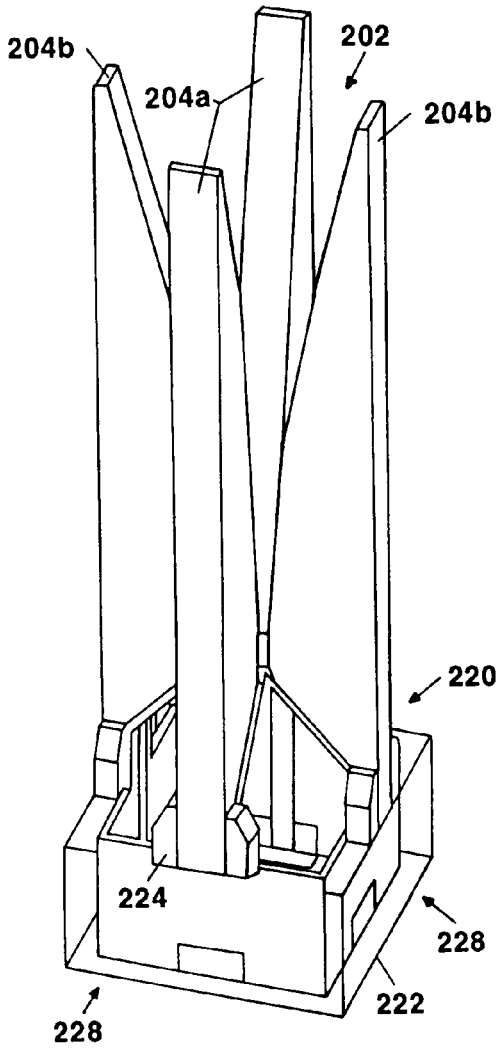
FIG. 4 is an isometric view of a unit cell.

Referring now to FIG. 4, a unit cell 202 includes a plurality of fin-shaped elements 204*a*, 204*b* disposed over a balanced symmetrical pyramidal feed circuit 220. Each pair of radiator elements 204*a* and 204*b* is centered over the balanced symmetrical feed 220 which is disposed in an aperture (not visible in FIG. 4) formed in the cavity plate 12 (FIG. 1). The first one of the pair of radiator elements 204*a* is substantially orthogonal to the second one of the pair of radiator elements 204*b*. It should be appreciated that no RF connectors are required to couple the signal from/to the balanced symmetrical feed circuit 220. The unit cell 202 is disposed above the balanced symmetrical feed 220 which provides a single open cavity. The inside of the cavity walls are denoted as 228.

Figure 4A:
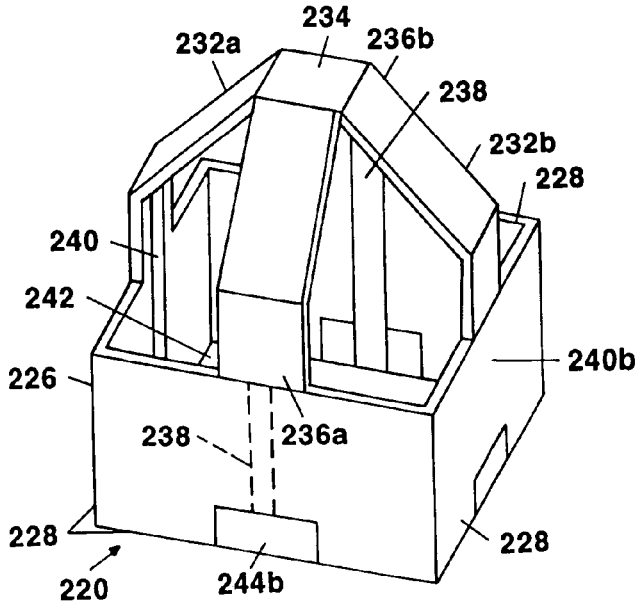
FIG. 4A is an isometric view of the balanced symmetrical feed of FIG. 4.

Referring to FIG. 4A, the exemplary balanced symmetrical feed 220 of the unit cell 202 includes a housing 226 having a center feed point 234 and feed portions 232*a* and 232*b* corresponding to one polarization of the unit cell and feed portions 236*a* and 236*b* corresponding to the orthogonal polarization of the unit cell. The housing 226 further includes four sidewalls 228. Each of the feed portions 232*a* and 232*b* and 236*a* and 236*b* have an inner surface and includes a microstrip feed line (also referred to as RF feed line) 240 and 238 which are disposed on the respective inner surfaces. Each microstrip feed line 240 and 238 is further disposed on the inner surfaces of the respective sidewalls 228. The microstrip feed lines 238 and 240 cross under each corresponding fin-shaped substrate 204*a*, 204*b* and join together at the center feed point 234. The center feed point 234 of the unit cell is raised above an upper portion of the sidewalls 228 of the housing 226. The housing 226, the sidewalls 228 and the cavity plate 212 provide the cavity 242. The microstrip feed lines 240 and 238 cross at the center feed point 234, and exit at the bottom along each wall of the cavity 242. As shown a microstrip feed 244*b*, formed where the metalization layer on sidewall 228 is removed, couples the RF signal to the aperture 222 in the cavity plate 212. In the unit cell 202, a junction is formed at the center feed point 234 and according to Kirchoffs node theory the voltage at the center feed point 234 will be zero.

In one particular embodiment, the balanced symmetrical feed 220 is a molded assembly that conforms to the feed surface of the substrate of the fins 204*a* and 204*b*. In this particular embodiment, the microstrip feed lines 240 and 238 are formed by etching the inner surface of the assembly. In this particular embodiment, the housing 226 and the feed portions 232 and 236 molded dielectrics. In this embodiment, the radiator height is 0.250 inches, the balanced symmetrical feed 220 is square shaped with each side measuring 0.285 inches and having a height of 0.15 inches. The corresponding lattice spacing is 0.285 inches for use at a frequency of 7–21 GHz. At the center feed point 234, a 0.074 inch square patch of ground plane material is removed to allow the RF fields on the microstrip feed lines 240 and 238 to propagate up the radiator elements 204 and radiate out the aperture. In order to radiate properly the microstrip feed lines 240 and 238 for each polarization are fed 180 degrees out-of-phase so when the two opposing signals meet at the center feed point 234 the signals cancel on the microstrip feed lines 240 and 238 but the energy on the microstrip feed lines 240 and 238 is transferred to the radiator elements 204*a* and 204*b* to radiate outward. For receive signals, the opposite occurs where the signal is directed down the radiator elements 204*a* and 204*b* and is imparted onto the microstrip feed lines 240 and 238 and split into two signals 180 degrees out-of-phase. In another embodiment, the balun (not shown) is incorporated into the balanced symmetrical feed 220.

Figure 5:
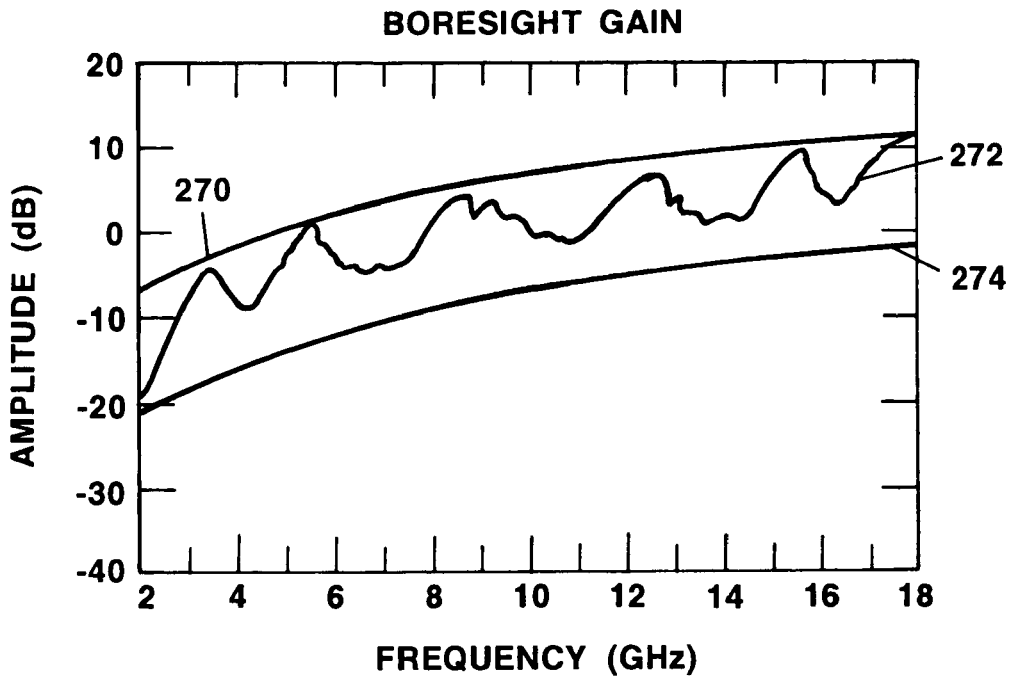
FIG. 5 (PRIOR ART)
FIG. 5 is a frequency response curve of a prior art radiator array.

Referring now to FIG. 5, a curve 272 represents the swept gain of a prior art center radiator element at zero degrees boresight angle versus frequency. Curve 270 represents the maximum theoretical gain for a radiator element and curve 274 represents a curve 6 db or more below the gain curve 270. Resonances present in the prior art radiator result in reduction in antenna gain as indicated in curve 272.

Figure 5A:
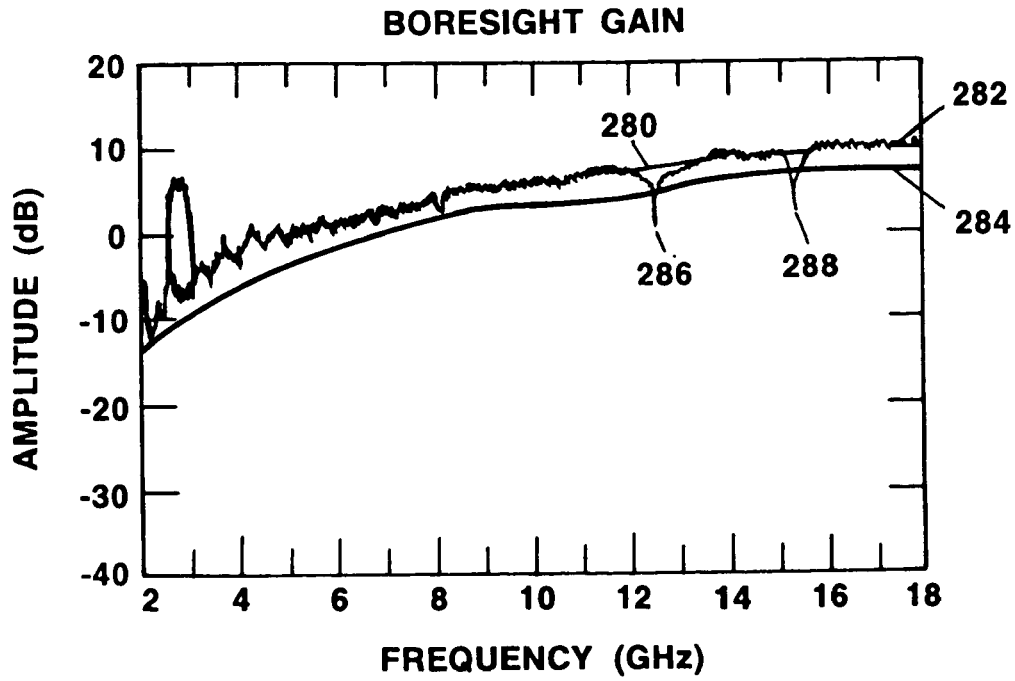
FIG. 5A is a frequency response curve of the radiator array of FIG. 1.

Referring now to FIG. 5A, a curve 282 represents the measured swept gain of the concentrically fed electrically short crossed notch radiator element 100' of FIG. 3 at zero degrees boresight angle versus frequency. Curve 280 represents the maximum theoretical gain for a radiator element and curve 284 represents a curve approximately 1–3 db below the gain curve 280. The curve has a measurement artifact at point 286 and a spike at point 288 due to grating lobes. Comparing curves 272 and 282, it can be seen that there is a difference of approximately 6 dB (4 times in power) between the gain of the electrically short crossed notch radiator element 100' compared to the prior art radiator element. Therefore, approximately four times as many prior art radiator elements (or equivalently four times the aperture size of an array of prior art radiators) would be required to provide the performance of one of the electrically short crossed notch radiator element 100' of FIG. 3 over a 9:1 bandwidth range. Because of the performance of the electrically short crossed notch radiator element 100', the element 100' can operate as an allpass device.

When fed by a balun approaching ideal performance, the electrically short crossed notch radiator element 100' can be considered as a 4-port device, one polarization is generated with ports one and two being fed at uniform magnitude and a 180° phase relationship. Ports three and four excited similarly will generate the orthogonal polarization. From two through eighteen GHz, the mismatch loss is approximately 0.5 dB or less over the cited frequency range and 60° conical scan volume. The impedance match also remains well controlled over most of the H-plane scan volume.

Figure 6:
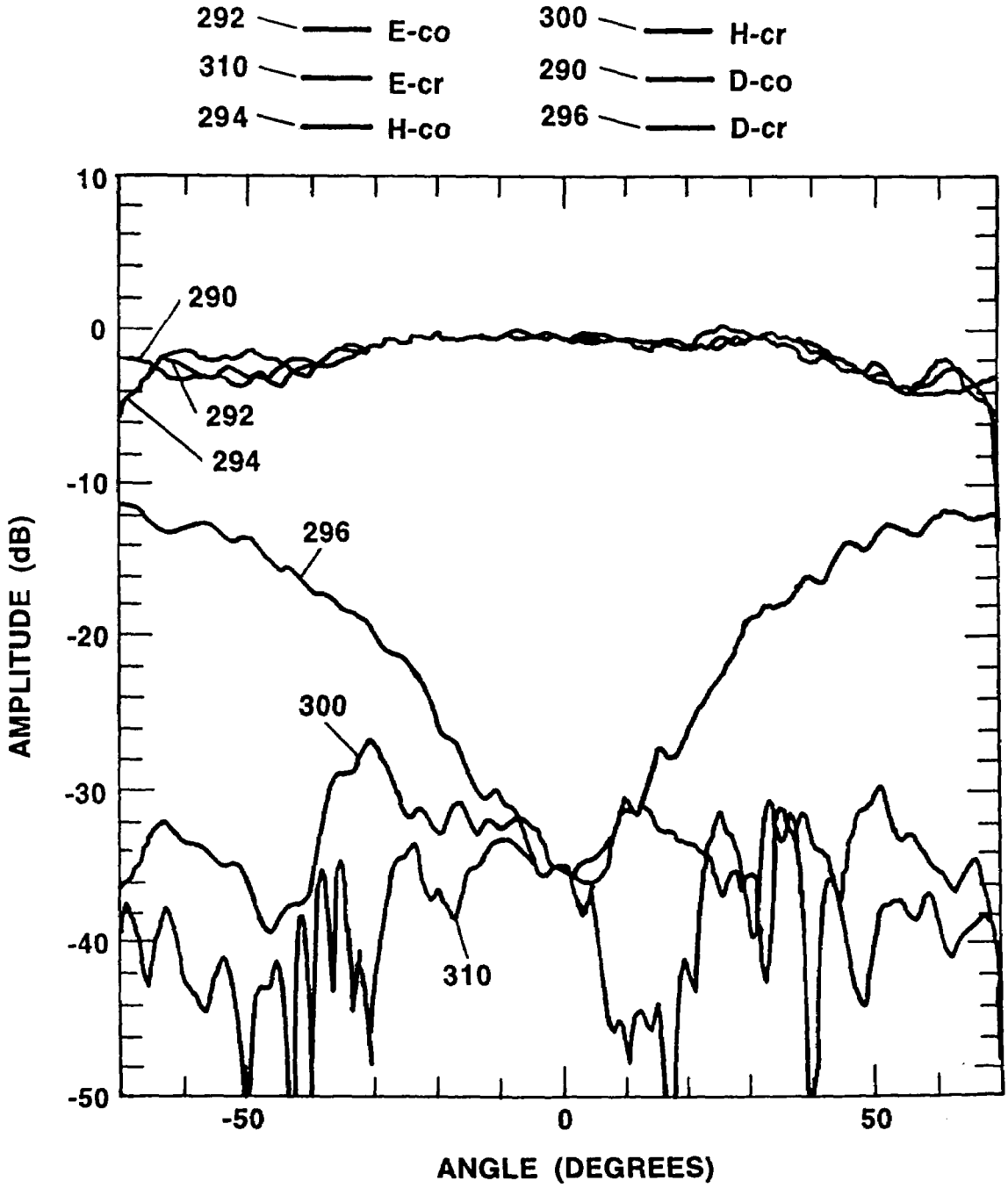
FIG. 6 is a radiation pattern of field power for a single antenna element of the type shown in the array of FIG. 1 embedded in the center of an array with all other radiators terminated. Patterns are given for the co-polarized and cross-polarized performance for the various planes (E, H, and diagonal (D))

Referring now to FIG. 6, a set of curves 292–310 illustrate the polarization purity of the electrically short crossed notch radiator element 100' (FIG. 3). The curves are generated for a single antenna element of the type shown in the array of FIG. 1 embedded in the center of an array with all other radiators terminated.

An embedded element pattern is the element pattern in the array environment that includes the mutual coupling effects. The embedded element pattern taken on a mutual coupling array (MCA) was measured. The data shown was taken on the center element of this array near mid band.

Patterns are given for the co-polarized and cross-polarized performance for the various planes (E, H, and diagonal (D)). As can be seen from the curves 292–310, the antenna is provided having better than 10 dB cross-polarization isolation over a 60° conical scan volume. Curves 292, 310 illustrate the co-polarized and cross-polarized patterns of the center element in the electrical plane (E), respectively. Curves 294 and 300 illustrate the co-polarized and cross-polarized patterns of the center element in the magnetic plane (H), respectively. Curves 290 and 296 illustrate the co-polarized and cross-polarized patterns of the center element in the diagonal plane, respectively. Curves 292, 310, 294, 300, 290, and 296 illustrate that the electrically short crossed notch radiator element 100' exhibits good cross-polarization isolation performance.

In an alternate embodiment, an assembly of two sub components, the fins 102 and 102' and the balanced symmetrical feed circuits 108 and 108' of FIGS. 1 and 3 respectively, are provided as monolithic components to guarantee accurate alignment of the fins with each other and equal gap spacing at the feed point. By keeping tolerances at a minimum and unit-to-unit uniformity, consistent performance over scan angles and frequency can be achieved.

In a further embodiment, the fin components of the radiator elements 100 and 100' can be machined, cast, or injection molded to form a single assembly. For example, a metal matrix composite such as AlSiC can provide a very lightweight, high strength element with a low coefficient of thermal expansion and high thermal conductivity.

In another alternate embodiment, radiator elements 100 and 100' are protected from the surrounding environment by a radome (not shown) disposed over the radiating elements in the array. The radome can be an integral part of the antenna and used as part of the wideband impedance matching process as a single wide angle impedance matching sheet or an A sandwich type radome can be used as is known in the art.

All publications and references cited herein are expressly incorporated herein by reference in their entirety.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims.

What is claimed is:

1. A radiator element comprising:

a first air of notch radiator elements s aced a art from one another and disposed in a first plane, each of said notch radiator elements having a feed surface;

a second pair of notch radiator elements spaced apart from one another and disposed in a second plane which is substantially orthogonal to the first plane in which the first pair of notch radiator elements is disposed, such that the first pair of notch radiator elements are disposed to receive RF signals having a first polarization and the second pair of notch radiator elements are disposed to receive RF signals having a second polarization which is orthogonal to the first polarization said first and second pairs of notch radiator elements being symmetrically disposed about a centerline defined by an intersection of the first and second planes and each of said notch radiator elements; and a balanced symmetrical feed including:

a first pair of radio frequency (RF) feed lines, each of the RF feed lines disposed symmetrically about the centerline and each of the RF feed lines coupled to a feed surface the first air of notch radiator elements; and a second pair of RF feed lines, each of the RF feed lines disposed symmetrically about the centerline and each of the RF feed lines coupled to a feed surface of the second pair of notch radiator elements wherein with the first and second pairs of RF feed lines are coupled to the first and second pairs of notch radiator elements such that the first and second pairs of notch radiator elements are provided having coincident phase centers adjacent the transition section wherein the balanced symmetrical feed is provided as a raised balanced symmetrical feed and further comprises:

a housing having four sidewalls with each sidewall having an upper edge surface and a lower edge surface, the housing having a central longitudinal axis which is aligned with the centerline defined by the intersection of the first and second planes; and a raised structure projecting from the upper edge surface of said sidewalls, said raised structure having a substantially pyramidal shape with each of the feed lines in the first and second pairs of feed lines disposed on one of the four sidewalls and on one of the four sides of the pyramidal-shaped structure wherein each of the feed lines have an end which terminates at a point on the pyramidal-shaped structure which is substantially aligned with the centerline defined by the intersection of the first and second planes.

2. The radiator element of claim 1 wherein:

the feed lines are provided as microstrip transmission lines; and each of the notch radiator elements are provided as fin-shaped substrates coupled to the pyramidal structure of said balanced symmetrical feed.

3. The radiator element of claim 1 wherein the notch radiator elements are each provided from an electrically conductive material.

4. The radiator element of claim 3 wherein the notch radiator elements are each provided from a fin-shaped conductive substrate.

5. The radiator element of claim 1 wherein the notch radiator elements are each provided from a fin-shaped dielectric substrate having a conductive material disposed thereover.

6. The radiator element of claim 1 wherein each of the substrates has a height of less than approximately $0.25\lambda_L$, where $\lambda_L$ corresponds to a wavelength of a low end of a range of operating wavelengths.

7. The radiator element of claim 1 wherein the balanced symmetrical feed further comprises:

a plurality of sidewalls, each of the sidewalls having first and second opposing surfaces, a top edge and a bottom edge, said sidewalls arranged to form a cavity having an open end; and wherein each of the feed lines from the first and second pair of RF feed lines are disposed on one sidewall surface and are electromagnetically coupled to a corresponding one of the notch radiator elements.

8. The radiator element of claim 7 wherein each of the RF feed lines has first end and a second end with the first end of each of the RF feed lines being coupled to the notch radiator elements and the radiator element further comprises a balun having a plurality of ports, each of the output ports coupled to a corresponding one of the second ends of the RF feed lines.

9. The radiator element of claim 8 further comprising a pair of amplifiers each coupled between a corresponding one of the balun output ports and the second feed end of one of the RF feed lines.

10. A wideband antenna comprising:

a cavity plate having a first surface and a second opposing surface;

a first plurality of fins disposed on the first surface of the cavity plate spaced apart from one another forming a first plurality of tapered slots having a feed surface, said first plurality of fins disposed to receive radio frequency (RF) signals having a first polarization;

a second plurality of fins disposed on the first surface of the cavity plate spaced apart from one another forming a second plurality of tapered slots having a feed surface, each of said second plurality of fins disposed to receive RF signals having a second polarization, with the second polarization being substantially orthogonal to the first polarization; and a plurality of balanced symmetrical feed circuits disposed on the first surface of said cavity plate, each of said plurality of balanced symmetrical feed circuits having two opposing pairs of radio frequency (RF) feed lines with each RF feed line from the first pair of RF feed lines electromagnetically coupled to the feed surface of a corresponding one of a first pair of fins of the first plurality of fins and each RF feed line from the second pair of RF feed lines coupled to the feed surface of respective one of a first pair of fins of the second plurality of fins wherein the feed lines from the balanced symmetrical feed circuits are coupled to the first and second plurality of fins such that the first and second plurality of fins are provided having coincident phase centers.

11. The wideband antenna of claim 10 wherein the cavity plate further comprises a plurality of apertures; and wherein each of the plurality of balanced symmetrical feed circuits is disposed in a corresponding one of the plurality of apertures.

12. The wideband antenna of claim 10 further comprising a connector plate disposed adjacent the second surface of the cavity plate and having a plurality of connections;

and wherein each of the plurality of balanced symmetrical feed circuits has a plurality of feed connections each coupled to a corresponding one of the plurality of connector plate connections.

13. The antenna of claim 10 wherein each of the fins has a height of less than about approximately $0.25\lambda_L$, where $\lambda_L$ refers to the wavelength of the low end of a range of operating wavelengths.

14. The antenna of claim 10 wherein each of the plurality of balanced symmetrical feed circuits is a raised feed circuit having a shape which conforms to the feed surfaces of a corresponding one of the plurality of fins.

15. The antenna of claim 10 further comprising a plurality of baluns each coupled to a corresponding RF feed line.

16. The antenna of claim 15 further comprising a plurality of RF connectors each coupled to a corresponding one of the plurality of baluns.

17. A radiator element comprising:

a first pair of notch radiator elements spaced apart from one another and disposed in a first plane, each of said notch radiator elements having a feed surface and being capable of operating over a fractional bandwidth of not less the 3:1;

a second pair of notch radiator elements spaced apart from one another and disposed in a second plane which is substantially orthogonal to the first plane in which the first pair of notch radiator elements is disposed, such that the first pair of notch radiator elements are disposed to receive RF signals having a first polarization and the second pair of notch radiator elements are disposed to receive RF signals having a second polarization which is orthogonal to the first polarization, said first and second pairs of notch radiator elements being symmetrically disposed about a centerline defined by an intersection of the first and second planes and each of said notch radiator elements having a feed surface and being capable of operating over a fractional bandwidth of not less the 3:1; and a raised balanced symmetrical feed including:

a first pair of radio frequency (RF) feed lines, each of the RF feed lines disposed symmetrically about the centerline and each of the RF feed lines coupled to a feed surface of the first pair of notch radiator elements;

a second pair of RF feed lines, each of the RF feed lines disposed symmetrically about the centerline and each of the RF feed lines coupled to a feed surface of the second pair of notch radiator elements wherein with the first and second pairs of RF feed lines are coupled to the first and second pairs of notch radiator elements such that the first and second pairs of notch radiator elements are provided having coincident phase centersdjacent the transition sections;

a housing having four sidewalls with each sidewall having an upper edge surface and a lower edge surface, the housing having a central longitudinal axis which is aligned with the centerline defined by the intersection of the first and second planes; and a raised structure projecting from the upper edge surface of said sidewalls, said raised structure having a substantially pyramidal shape with each of the feed lines in the first and second pairs of feed lines disposed on one of the four sidewalls and on one of the four sides of the pyramidal-shaped structure wherein each of the feed lines have an end which terminates at a point on the pyramidal-shaped structure which is substantially aligned with the centerline defined by the intersection of the first and second planes.

18. The radiator element of claim 17 wherein:

the feed lines are provided as microstrip transmission lines; and each of the notch radiator elements are provided as fin-shaped substrates coupled to the pyramidal structure of said balanced symmetrical feed.

19. The radiator element of claim 17 wherein the notch radiator elements are each provided from an electrically conductive material.

20. The radiator element of claim 17 wherein the notch radiator elements are each provided from a fin-shaped conductive substrate.

21. The radiator element of claim 17 wherein the notch radiator elements are each provided from a fin-shaped dielectric substrate having a conductive material disposed thereover.

22. The radiator element of claim 17 wherein each of the substrates has a height of less than approximately $0.25\lambda_L$, where $\lambda_L$ corresponds to a wavelength of a low end of a range of operating wavelengths.

23. The radiator element of claim 17 wherein:

said sidewalls of the balanced symmetrical feed are arranged to form a cavity having an open end; and each of the feed lines from the first and second pair of RF feed lines are disposed on one sidewall surface and are electromagnetically coupled to a corresponding one of the notch radiator elements.

24. The radiator element of claim 23 wherein each of the RF feed lines has first end and a second end with the first end of each of the RF feed lines being coupled to the notch radiator elements and the radiator element further comprises a balun having a plurality of ports, each of the output ports coupled to a corresponding one of the second ends of the RF feed lines.

25. The radiator element of claim 24 further comprising a pair of amplifiers each coupled between a corresponding one of the balun output ports and the second feed end of one of the RF feed lines.

* * * * *

UNITED STATES PATENT AND TRADEMARK OFFICE

CERTIFICATE OF CORRECTION

PATENT NO. : 7,180,457 B2
APPLICATION NO. : 10/617620
DATED : February 20, 2007
INVENTOR(S) : Trott et al.

It is certified that error appears in the above-identified patent and that said Letters Patent is hereby corrected as shown below:

Column 1, line 54 delete "TED, mode," and replace with --$TE_{01}$ mode,--.

Column 3, line 67 delete "diagonal (D))" and replace with --diagonal (D)).--.

Column 4, line 11 delete "herein below" and replace with --hereinbelow--.

Column 5, line 14 delete "include but is not limited to a" and replace with --include, but is not limited to, a--.

Column 5, line 23 delete "the fin shaped" and replace with --fin-shaped--.

Column 6, lines 34-35 delete "including but not limited to the" and replace with --including, but not limited to, the--.

Column 6, line 51 delete "FIG. 1 portions" and replace with --FIG. 1, portions--.

Column 7, line 10 delete "to".

Column 7, line 26 delete "radiators" and replace with --radiator--.

Column 8, line 7 delete "appreciated two" and replace with --appreciated that two--.

Column 8, line 21 delete "herein after" and replace with --hereinafter--.

Column 8, line 24 delete "layer" and replace with --layers--.

Column 8, line 32 delete "In operations RF signals" and replace with --In operation, RF signals--.

Column 8, line 46 delete "wing" and replace with --using--.

Column 9, line 15 delete "layer" and replace with --layers--.

Column 9, line 16 delete "surface" and replace with --surfaces--.

Column 9, line 20 delete "surface" and replace with --surfaces--.

Column 9, line 23 delete "substrate" and replace with --substrates--.

Column 9, line 47 delete "The transition section 105'" and replace with --The transition sections 105'--.

UNITED STATES PATENT AND TRADEMARK OFFICE

CERTIFICATE OF CORRECTION

PATENT NO. : 7,180,457 B2
APPLICATION NO. : 10/617620
DATED : February 20, 2007
INVENTOR(S) : Trott et al.

It is certified that error appears in the above-identified patent and that said Letters Patent is hereby corrected as shown below:

Column 10, line 3 delete “the or RF” and replace with --the RF--.

Column 10, lines 17-18 delete “layer” and replace with --layers--.

Column 10, line 23 delete “600.” and replace with --60°--.

Column 10, line 43 delete “metallization layer 120d the” and replace with --metalization layer 120d, the--.

Column 10, line 60 delete “In one embodiment the” and replace with --In one embodiment, the--.

Column 11, line 18-19 delete “appreciated the” and replace with --appreciated that the--.

Column 11, line 58 delete “In one embodiment the” and replace with --In one embodiment, the--.

Column 11, line 63 delete “For receive applications balum” and replace with --For receive applications, balun--.

Column 12, line 1 delete “cirucit” and replace with --circuit--.

Column 12, lines 17-19 delete “(previous discussion page 15 line 6 had less than --- guess this should be much shorter)”.

Column 13, line 8 delete “As shown a” and replace with --As shown, a--.

Column 13, line 12 delete “theory the” and replace with --theory, the--.

Column 13, line 29 delete “properly the” and replace with --properly, the--.

Column 15, line 6 delete “a first air” and replace with --a first pair--.

Column 15, line 6 delete “s aced a art” and replace with --spaced apart--.

Column 15, line 26 delete “first air” and replace with --first pair--.

Column 17, line 23 delete “less the 3:1;” and replace with --less than 3:1;--.

UNITED STATES PATENT AND TRADEMARK OFFICE

CERTIFICATE OF CORRECTION

PATENT NO. : 7,180,457 B2
APPLICATION NO. : 10/617620
DATED : February 20, 2007
INVENTOR(S) : Trott et al.

It is certified that error appears in the above-identified patent and that said Letters Patent is hereby corrected as shown below:

Column 17, line 38 delete “less the 3:1; and” and replace with --less than 3:1; and--.

Column 17, line 53 delete “centersdjacent” and replace with --centers adjacent--.

Signed and Sealed this

Twenty Second Day of April, 2008

JON W. DUDAS
*Director of the United States Patent and Trademark Office*